United States Patent [19]

Salonen

[11] 3,954,206

[45] May 4, 1976

[54] APPLICATOR FOR EXTRUDING MOLTEN THERMOPLASTIC MATERIAL

[76] Inventor: Albert R. Salonen, 560 Baxter Ave., Victoria, B. C., Canada, V8Z 2G7

[22] Filed: Jan. 30, 1974

[21] Appl. No.: 437,816

[52] U.S. Cl. ..... 222/146 HE; 219/421; 222/333; 425/144

[51] Int. Cl.[2] ..... B27G 11/02

[58] Field of Search ..... 222/146 HE, 146 H, 146 R, 222/333; 165/86, 185, 30; 219/421; 228/52, 53; 425/143, 144, 378, DIG. 13

[56] References Cited

UNITED STATES PATENTS

| | | | |
|---|---|---|---|
| 2,363,375 | 11/1944 | Wild | 165/30 X |
| 2,518,748 | 8/1950 | Breer et al. | 222/146 HE X |
| 2,839,653 | 6/1958 | Kane | 222/146 HE X |
| 2,979,234 | 4/1961 | Kamborian | 219/421 X |
| 3,750,905 | 8/1973 | Wolfrom | 222/146 HE X |
| 3,773,069 | 11/1973 | Rebentisch | 222/146 HE X |

*Primary Examiner*—Robert B. Reeves
*Assistant Examiner*—Thomas E. Kocovsky

[57] ABSTRACT

A hand held applicator for extruding molten thermoplastic material wherein a supply of the material is contained within an attached receptacle, which receptacle is provided with means for melting a portion of the material contained therein. The melted material within the receptacle is drawn under reduced pressure into a passageway extending through a heated member, and is extruded under increased pressure from a valve controlled orifice provided on one end of the passageway by means of either a motor driven conveyor screw or an electromechanical solenoid actuated piston. Heat for melting the plastic material is conducted from the heated member to the inside of the receptacle by means of a metallic duct member which communicatively connects the inside base region of the receptacle to the passageway. Melting of the plastic material is confined to the base region of the receptacle by thermally insulating the walls of the receptacle from the heated inner base region. Means are provided for regulating the temperature of the melted material at the base of the receptacle.

10 Claims, 2 Drawing Figures

APPLICATOR FOR EXTRUDING MOLTEN THERMOPLASTIC MATERIAL

This invention relates generally to extruding apparatus, and more particularly to a small, portable, hand-held device for extruding hot melt adhesives.

Thermoplastic materials have proved to be useful as adhesives in a wide variety of applications, and are compatible as a means of attachment for many types of materials. A number of thermoplastic extruding devices have been developed for applying the adhesive material, which devices usually have a heatable chamber portion communicating with a supply of material, and a feed means for urging the thermoplastic material through the heatable chamber for extrusion therefrom in a liquefied form.

Though applicators for extruding molten plastic material are many and varied, they are in many instances specialized as to the types of material usable, and in the physical form the material must have for feeding into the device. Many of the newer thermoplastic materials developed for use as an adhesive have a viscous consistancy at ambient temperature, and have a resilient, sticky surface; hence can not be conveniently handled in the form of strips, rods or pellets. Devices for utilizing this type of material usually employ a heated container for melting the supply stock; the molten material then being pressurized and conveyed to an applicator which can be held and manipulated by one hand of the operator. The disadvantages which may be attributed to this general type of applicator is the degradation of the plastic material while in the device because the material is held in a molten state for extended periods of time, and to the overall size and complexity of the device.

In accordance with the aforegoing, it may be regarded as an object of the present invention to provide an extruding device for applying molten thermoplastic materials which is light and compact so that it can be readily held in any position and actuated by one hand of the operator, and which includes a self-contained supply of plastic material.

It is a further object of the present invention to provide a device for extruding molten thermoplastic material wherein a supply of material can be conveniently loaded into the device.

It is yet a further object of the present invention to provide a device for extruding thermoplastic material wherein only small quantities of the material are heated and melted prior to extrusion.

And a further object of the present invention is to provide a hand-held device for extruding molten thermoplastic materials in a continuous stream or bead under precise control of the operator.

In the present invention, the foregoing objects as will become apparent in the course of the ensuing specification are achieved in a hand-held apparatus by having a receptacle for the plastic material supply composed of a non-metallic, heat resistant material with minimal heat conducting properties, and by having the receptacle attached to a heatable enclosing member for an extruding mechanism by means of a metallic duct member which passes through the base of the receptacle, so that the metal of the duct member provides a means for conducting heat from the enclosing member into the base portion of the receptacle for melting the material adjacent thereof; the bore of the duct member providing a passageway for the molten plastic material to flow from the inside base region of the receptacle to the bore of the enclosing member. The plastic material is loaded into the receptacle in the form of a solid cake, and held against the base portion by light spring pressure; the melting of the plastic material taking place only in the base region of the receptacle because the sidewalls of the receptacle are unheated.

A motor driven conveyor screw within the bore of the enclosing member, by inducing a reduction in pressure within the passageway of the duct, operates to draw the molten material from the base region of the receptacle into the bore of the enclosing member, and by inducing an increase in pressure on the molten material in the bore, operates to extrude the material in a continuous bead or stream from a nozzle which can be controlled by a valve means provided on the end of the enclosing member.

Since a conveyor screw rotating in a viscous fluid does not have a positive displacement, the conveyor screw in such a device can continue rotating while the flow from the orifice is controlled by a valve to give close control over the amount of discharge, or even closed off completely. This reduces the demands on control over the motor drive for the conveyor screw, so that an alternating current induction motor or an air driven motor can be employed as the powering means.

An alternative means for drawing the molten material into the bore of the enclosing member and for extruding the material therefrom is a piston reciprocated by an electromechanical solenoid; the head of the piston being at all times clear of the passageway leading into the duct member. In this alternative means, a one way check valve is provided in the duct member and a similar valve is provided in the enclosing member downstream from the piston head. The piston oscillates with very short strokes, thereby giving pulsating continuous extrusion of the molten material which is controllable by a valve as in the conveyor screw version.

In the solenoid version, as the flow of liquid is throttled by the valve, a buildup of the molten material in the bore of the enclosing member, by acting on the piston, forces the armature of the solenoid further into regions of decreasing magnetic effect within the solenoid. This reduces both the length of the excursion of the armature and of the force acting on the piston urging the molten material toward the orifice.

As the molten material is extruded from the nozzle orifice, the molten material at the base of the receptacle flows slowly inward toward the duct opening, and hence the temperature at the base need be only sufficient to bring the material to a viscous condition. Unless means for regulating the heat input to the base is incorporated into the device, the temperature in the base region will approach that of the housing member, particularly if the device is left standing with the housing member heater energized, and consequently the melting of the material in the receptacle may proceed beyond the region of the base. Since the temperature in the base region can be considerably lower than that of the housing member, a regulating means wherein the inner base of the receptacle is a bi-metal diaphragm supported at the outer edges will control input of heat to the base in a manner similar to that of a thermostatically controlled, electrical heater. The diaphragm is in contact with the duct member when cold, and then bulges away to withdraw from the duct member when heated. This arrangement has desirable features in that the diaphragm draws heat from a heat sink for rapid input, which in this instance is the metallic duct member attached to the housing member, and has a constant heat input at lower, varying levels by radiation and by conduction through the air of the narrow gap from the duct member when not in contact. The diaphragm is responsive to the drop in temperature as the extruding mechanism draws the hot molten material from the base of the receptacle, and closes the gap or makes contact with the metallic duct member to increase the heat input therefrom; and since the duct member and heated housing member have a substantial thermal reserve, the temperature is quickly restored.

For maximum convenience in handling the plastic material while loading the device, and to eliminate any tendency of the material to stick to the sidewalls of the receptacle, the aforesaid cake of plastic material can be partially enclosed by a thin foil or membrane. The foil enclosure is crushed by atmospheric pressure as the molten material is withdrawn through the duct member; the crushed ring then being discarded when a new cake of material is loaded. The membrane is composed of a compatible plastic material which dissolves in the supply plastic material when the latter is heated and melted, and then mixes into the molten material to accompany the extrudate from the nozzle orifice.

The features of the invention outlined in the foregoing will become apparent from the following detailed description which is to be taken in conjunction with the accompanying drawings in which.

Figure 1:
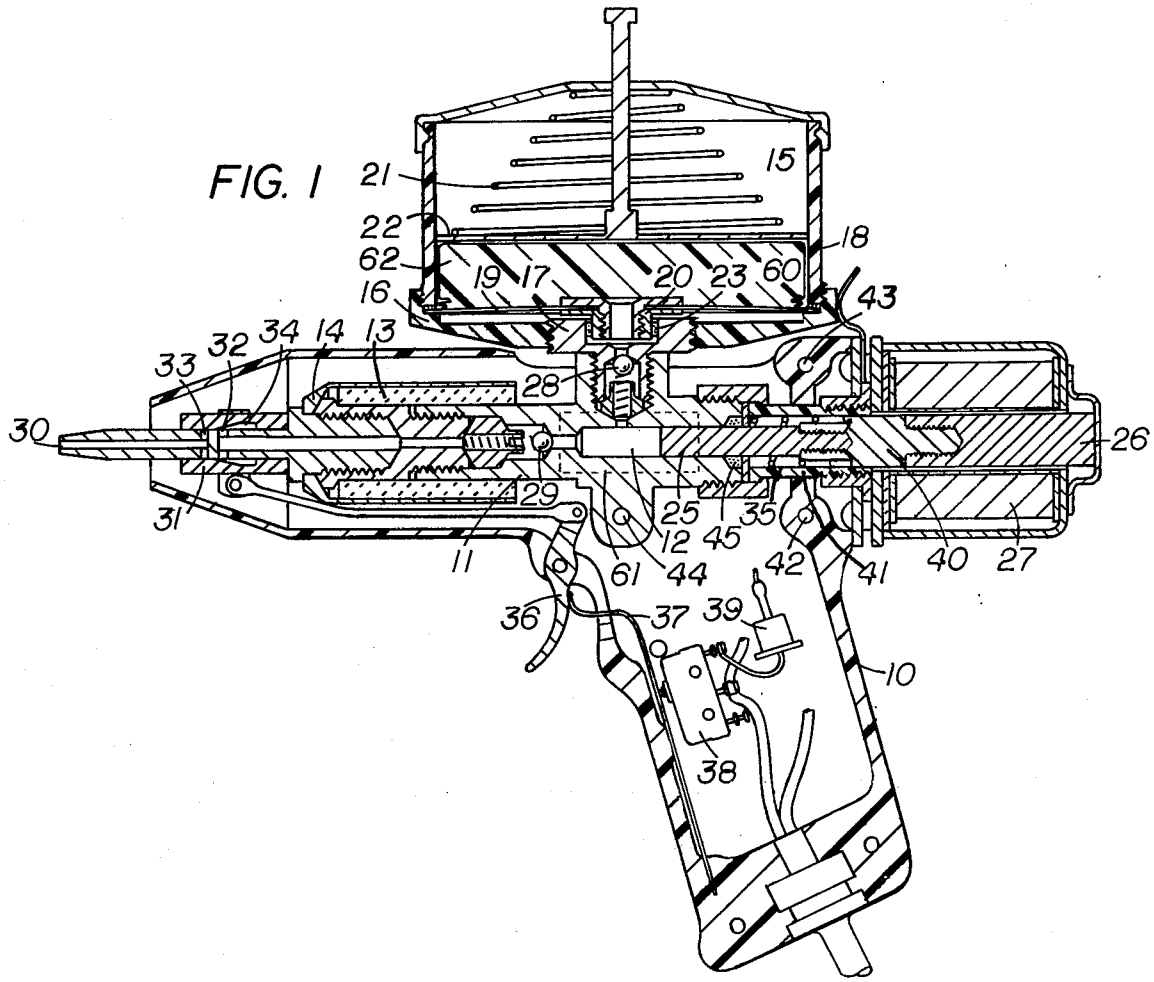
FIG. 1 is a side elevation sectional view of an applicator embodying features of this invention, including a piston extruding means which is reciprocable by an electromechanical solenoid.

Referring to the drawings, and particularly to FIG. 1 the device of this invention is constructed in the form of a hand held gun having a handle attached to a body portion 10, preferably made of some suitable non-metallic and heat resistant material and formed in two halves to receive and support a member 11 provided with a passageway 12. The member 11 is encircled on one end by an electrical resistance heating element 13; the element being partially enclosed by a metallic shield 14 to increase the efficiency of heat transfer from the element to the member 11.

The plastic material supply for the device is supported close to the heated member in a receptacle 15, which receptacle is largely made of some suitable non-metallic and heat insulating material. The receptacle 15 is attached to the device by having the base portion 16 of the receptacle threaded on to the end of a metallic duct member 17 which is fastened to the heated member 11. The temperature of the member 11 is regulated by an electrical thermostat 61 connected in series with the element 13 and is preferably attached to the member 11 close to the duct member 17.

Clamped between the base portion 16 and the sidewalls 18 of the receptacle is a bi-metal laminated diaphragm 19, having a higher expansion laminate located on the side away from the duct member 17, so that the diaphragm will bulge and draw away from the duct member when heated. The diaphragm 19 is initially heated by conduction from the duct member 17; direct metal to metal contact being made between a diaphragm seal member 20 and the duct member 17; and then by radiation and conduction through the air from the duct member across the gap between the closely spaced adjacent surfaces as the diaphragm draws away. The separation of the gap will vary in accordance with the temperature of the diaphragm 19 and is adjusted by rotating the receptacle on the screw thread which holds the receptacle base 16 to the duct member 17.

The plastic material in the receptacle 15 is urged toward the diaphragm 19 by pressure from a spring 21 pressing on a piston disk 22. The material in contact with the heated diaphragm 19 is melted by heat conducted from the heater member 11, and the temperature gradient through the material is stabilized by the gap between the duct member and the diaphragm so that only that material next to the diaphragm is melted. Since the sidewalls 18 of the receptacle are made of a heat insulating material, melting of the plastic material will be confined to the region at the base of the receptacle.

A passageway opening through the diaphragm 19 for the melted material is provided with the seal member 20 and a resilient gland 23 to seal the duct assembly against leakage of air so that the melted material can be drawn through the duct member 17 under reduced pressure.

A piston 25 in the passageway 12 is reciprocated by the armature 26 of an electromechanical solenoid, and induces pressure variations in the liquid within the passageway 12, which variations, in concert with a check valve 28 in the duct member 17 and a check valve 29 in the passageway 12, induce a reduction of pressure on the liquid in the duct member to draw the melted material from the region at the base of the receptacle through the duct member 17 into the passageway 12, and an increase of pressure on the liquid in the passageway 12 to urge the liquid toward an orifice 30 for discharge therefrom. The volume of liquid flowing from the orifice is increased by sliding a sleeve valve 31 on the orifice body toward the orifice 30 which aligns a pair of radial openings 32 and 33 with a tapered annular cavity 34 in the valve 31, thereby permitting the liquid to flow from the passageway 12 through the cavity 34 and out of the orifice 30; the amount of flow is controlled or reduced by sliding the sleeve valve 31 away from the orifice opening 30 because of the increasing restriction imposed on the flow as the taper in the cavity gradually covers the opening 33.

As the volume of flow is reduced by the valve 31, a pressure buildup acting on the piston 25, combined with pressure from a spring 35 biased against the magnetic force from the solenoid coil 27, pushes the armature 26 into regions of lessening effect within the solenoid coil 27, which reduces both the length of the stroke of the armature, and of the magnetic forces acting on the armature for urging the piston toward the discharge opening on its pressure stroke. The solenoid coil 27 is energized by actuating a trigger 36 pivoted on the body member 10, which with the same motion slides the sleeve valve 31 toward the opening position; the motion of the trigger, through a leaf spring 37, closes a pair of contacts in the miniature micro-switch 38. The solenoid coil 27 and the micro-swtich 38 are connected in series to a power cord for connecting to a standard 110V power supply. To increase the available volume of molten plastic material for discharge from the orifice 30, a half wave solid state rectifier 39 is connected in series with the coil 27 and the switch 38. The rectified alternating current is converted into pulsating direct current which reduces the number of strokes of the armature by one-half but increases the length of the stroke by a factor of at least four.

A non-metallic, insulating member 40 is interposed between the piston 25 in the heated member 11 and the armature 26 of the solenoid for terminating thermal conduction from the piston to the armature. The solenoid coil 27 is attached to the member 11 by means of a non-metallic bushing 41 which also terminates thermal conduction from the heated member to the coil. The bushing 41 encloses the spring 35 and also supports one end of the member 11; the bushing 41 being clamped between the two halves of the body portion 10 by two screws at 42 and 43. The member 11 has a third attachment screw at 44 for clamping the body portion halves 10 to a lug projecting from the member 11.

A packing material 45 is set in an annular cavity at the end of the passageway 12 for sealing the end against entrance of air or leakage of molten material during operation of the device.

Figure 2:
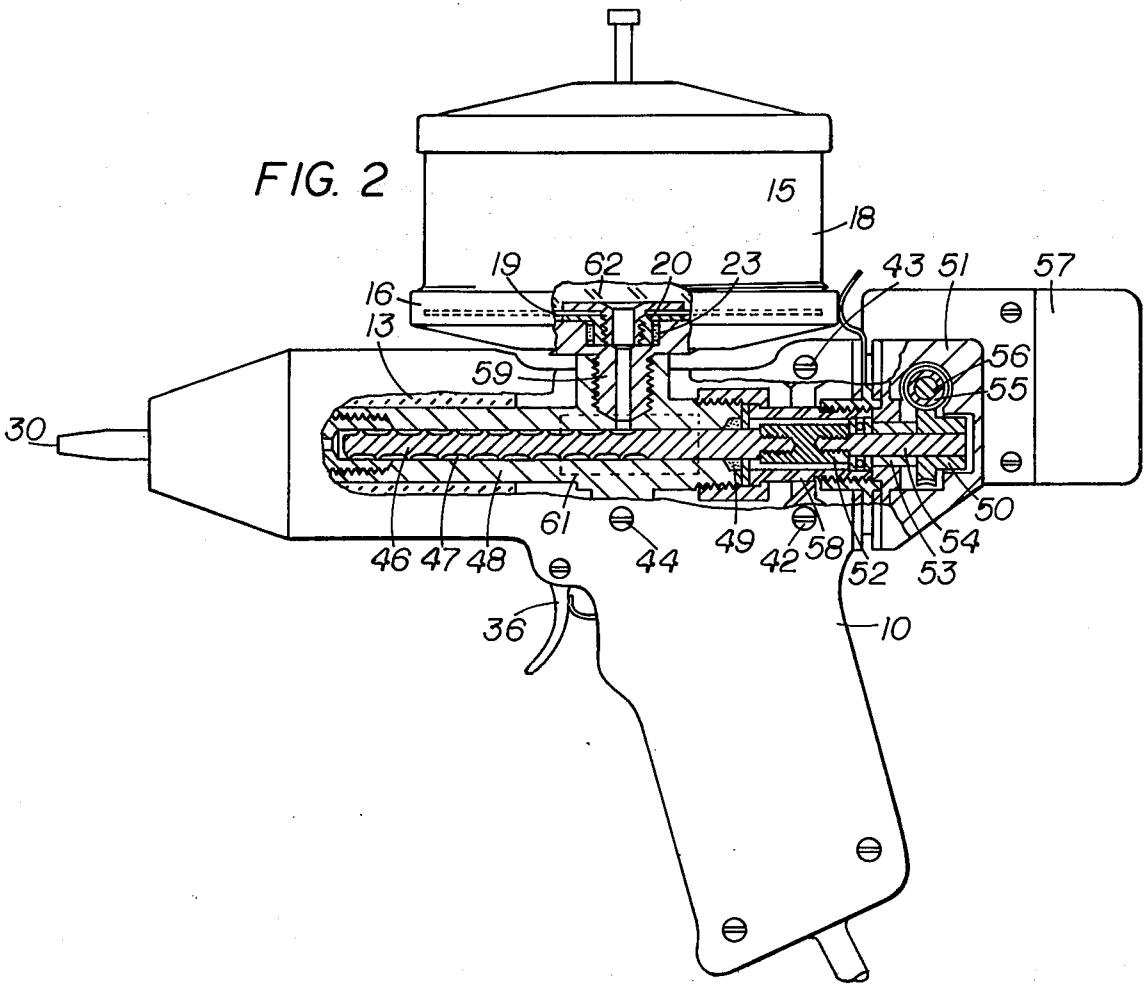
FIG. 2 is a side elevation partial sectional view of an applicator embodying features of this invention, including a conveyor screw extruding means which is rotatable by an electric motor through a worm gear drive.

FIG. 1 shows the diaphragm 19 within the receptacle 15 as it would appear when heated; the diaphragm is bulged at the centre and the contacting surfaces on the seal member 20 and on the duct member 17 are separated. In FIG. 2 the diaphragm is flat and the contacting surfaces are in thermal contact. As the heated material is withdrawn from the base of the receptacle, the laminated bi-metal diaphragm 19 is responsive to the drop in temperature and flattens, which closes the contacting surfaces to increase the heat input to the diaphragm from the heated member.

FIG. 2 illustrates a conveyor screw version of the device; the enclosed elements not visible are identical to those identified in the foregoing detailed description; the electrical rectifier 35 is not included in this version; and the elements which differ are illustrated in sectionalized form. In this version a conveyor screw 46 is rotatably mounted in a passageway 47 within a heated member 48 and is driven by a shaft extending through a packing gland 49 to a worm gear 50 in a gear box 51. The shaft has a non-metallic section 52 interposed beyond the gland 49 to terminate conduction of heat from the screw 46 to the sleeve bearing 53 supporting the stub shaft 54, and to the worm gear 50 and gear box 51. The worm gear 50 is rotated by a worm 55 which is rotated by a shaft 56 driven by an electric motor 57. A support-member 58 for the gear box 51 is made of non-metallic material to restrict conduction of heat from the heated member 48.

During operation of the device, the member 48 is heated with an element 13 similar to that in FIG. 1; the passageway in the duct member 59 and in the heated member 48 is filled with molten material from the receptacle; rotation of the screw 46 reduces the pressure in the duct member 59 and at the base of the receptacle 15 to draw the molten material into the passageway 47 and forces the material toward the orifice opening 30. The flow from the orifice is varied by a valve means similar to that in FIG. 1.

Prior to loading the plastic material into the device, the material is cast or otherwise preformed into a solid billet or cake 62; the size and shape of which is a loose fit within the receptacle 15.

Materials which have a sticky outer surface and/or are too easily deformed to hold a shape are cast into a thin metal foil container 60 which is loaded along with the material into the receptacle. The container is crushed by atmospheric pressure at the base of the receptacle as the liquefied material is withdrawn under reduced pressure by the extruding mechanism.

As an alternative, the container is composed of a material which is soluble and compatible with the plastic material as the material is melted at the base of the receptacle, and is mixed in and extruded from the nozzle 30 along with the molten extrudate.

Since the extruding mechanisms illustrated in FIG. 1 and in FIG. 2 have characteristics wherein the volume of liquid flow is controllable by a valve, the available pressure head of the extrudate is thereby limited, as is the motive power requirements. However, it is to be understood that the device can be adapted to include a positive displacement pump such as for example a gear pump to give a smooth continuous flow of extrudate at much higher pressures. Also the device illustrated in FIG. 2 can be adapted to have an air cylinder and piston as the forcing mechanism to push the piston 25 for very much higher pressures of the extrudate. Such adaptations would preferably include means for varying the available power output of the power means to coincide with the opening of the discharge orifice control valve for a controllable flow of the extrudate. Also it is to be understood that the sidewalls 18 of the receptacle 15 can be composed of a lightweight metal such as aluminum, providing that the sidewalls 18 are thermally insulated from the diaphragm 19.

Thus, the aforenoted objects and advantages are effectively attained. Although several preferred embodiments of the invention have been disclosed therein, the invention is in no sense limited thereby and should be determined by the scope of the appended claims.

I claim:

1. An applicator for extruding molten thermoplastic material comprising:

a body portion;

a member mounted on said body portion and provided with an elongated passageway extending therethrough;

means for heating said member;

a nozzle carried by said member and provided with a discharge opening communicating with one end of said passageway;

a valve means normally closing said one end of the passageway;

an inlet opening into said passageway at a location toward the other end thereof;

means for supplying molten plastic material into said inlet opening;

means for inducing a reduction in pressure in said inlet opening to draw the molten material from said supply means into said passageway and for inducing an increase in pressure on the molten material in said passageway to urge the material toward said nozzle;

said supplying means comprising a receptacle mounted on said applicator at a location adjacent said inlet opening for receiving and containing in solid form the plastic material that is to be melted, means for applying heat to the inner side of said receptacle at the region of said base to melt a portion of the material contained in said receptacle and for limiting the melting of the material within said receptacle to the inside base region thereof, comprising means for thermally insulating said inside base region from the walls of said receptacle to facilitate the maintenance of a difference in temperature between said inside base region and said walls, and heat-conductive means providing a heat conducting path between said inside base region and said member, including means for controlling the heat conductivity of said path to regulate the rate of thermal conduction from said member to said base region;

means for urging the plastic material contained in said receptacle toward said inside base region and being operable to effect establishment of a layer of molten plastic material adjacent said inside base region as the plastic material is melted by heat therefrom, and duct means communicatively connecting said inside base region to said inlet opening for conveying the molten material from said inside base region to said inlet opening.

2. An applicator for extruding molten thermplastic material comprising:

a body portion;

a member mounted on said body portion and provided with an elongated passageway extending therethrough;

means for heating said member;

a nozzle carried by said member and provided with a discharge opening communicating with one end of said passageway;

a valve means normally closing said one end of the passageway;

an inlet opening into said passageway at a location toward the other end thereof;

means for supplying molten plastic material into said inlet opening;

means for inducing a reduction in pressure in said inlet opening to drawn the molten material from said supplying means into said passageway and for inducing an increase in pressure on the molten material in said passageway to urge the material toward said nozzle;

said supplying means comprisng a receptacle mounted on said applicator at a location adjacent said inlet opening for receiving and containing in solid form the plastic material that is to be melted, means for urging the plastic material contained in said receptacle toward the base thereof;

means for applying heat to the inner side of said receptacle at the region of said base to melt a portion of the material contained in said receptacle and for limiting the melting of said material to the inside base region thereof, comprising means for thermally insulating said inside base region from the walls of said receptacle to facilitate the maintenance of a difference in temperature between said inside base region and said walls, and means arranged to provide a heat conduting path between said inside base region and said member, including temperature responsive means for establishing said path between said member and said inside base region for temperatures at said inside base region below a predetermined value, and duct means communicatively connecting said inside base region to said inlet opening for conveying the molten material from said region to said inlet opening.

3. An applicator for extruding molten thermoplastic material comprising:

a body portion;

a member mounted on said body portion and provided with an elongated passageway extending therethrough;

means for heating said member;

a nozzle carried by said member and provided with a discharge opening communicating with one end of said passageway;

a valve means normally closing said one end of the passageway;

an inlet opening into said passageway at a location toward the other end thereof;

means for supplying molten plastic material into said inlet opening;

means for inducing a reduction in pressure in said inlet opening to draw the molten material from said supplying means into said passageway and for inducing an increase in pressure on the molten material in said passageway to urge the material toward said nozzle;

said supplying means comprising a receptacle mounted on said applicator at a location adjacent said inlet opening for receiving and containing in solid form the plastic material that is to be melted, means for urging the plastic material contained in said receptacle toward the base thereof, means for applying heat to the inner side of said receptacle at the region of said base to melt a portion of the material contained in said receptacle, means for limiting the melting of the material within said receptacle to the inside base region thereof, including a laminated bi-metal means for regulating the thermal input to said inner side of the receptacle to maintain said base region at a predetermined temperature, and duct means communicatively connecting said inside base region to said inlet opening for conveying the molten material from said region to said inlet opening.

4. An applicator for extruding molten thermoplastic material as claimed in claim 3, including a container for enclosing said plastic material at least on the peripheral surface thereof adjacent the inner side-walls of said receptacle and operative to prevent said surface from contacting said inner side-walls, and said container being constructed of thin metallic foil so that said container is collapsed by atmospheric pressure as said material is withdrawn from said base region by said reduction in pressure.

5. An applicator for extruding molten thermoplastic material as claimed in claim 3, including a container for enclosing said plastic material at least on the peripheral surface thereof adjacent the inner side-walls of said receptacle and operative to prevent said surface from contacting said inner side-walls, and said container being composed of a material compatible and soluble in said molten material so that said container is extruded from said nozzle along with said molten material.

6. An applicator for extruding molten thermoplastic material as claimed in claim 3, wherein said inducing means comprises a conveyor screw rotatably mounted in said passageway, which screw is rotatable by a shaft extending through said other end and powered by a motor means mounted on said applicator.

7. An applicator for extruding molten thermoplastic material as claimed in claim 6, wherein a thermal insulating means is interposed between said conveyor screw and said motor means for terminating conduction of heat from said screw along said shaft to said motor means.

8. An applicator for extruding molten thermoplastic material as claimed in claim 3, wherein said inducing means comprises a piston reciprocally mounted in said passageway and coupled to a reciprocative means attached to said other end, and a normally closed valve in said duct means for releasing a flow of liquefied material into said passageway by said reduction of pressure, and a second normally closed valve interposed between said piston and said nozzle in said passageway for releasing a flow of liquefied material toward said discharge orifice by said increase of pressure.

9. An applicator for extruding molten thermoplastic material as claimed in claim 8, wherein said reciprocative means comprises an electromechanical solenoid, the armature of which solenoid is coupled to said piston, and the electrical coil of which solenoid is mounted on said applicator in fixed reference to said other end and operable when energized by an electric current of varying intensity or direction to reciprocate said piston in said passageway.

10. An applicator for extruding molten thermoplastic material as claimed in claim 8, wherein a thermal insulating means is interposed between said piston and said reciprocative means for terminating thermal conduction from said piston to said reciprocative means.

* * * * *